US005577984A

United States Patent [19]

Bare, II

[11] Patent Number: 5,577,984

[45] Date of Patent: Nov. 26, 1996

[54] FRAME FOR A VARIABLE IMPACT THERAPY SYSTEM

[76] Inventor: Frank L. Bare, II, 6320 S. 2141 East, Salt Lake City, Utah 84121

[21] Appl. No.: 243,195

[22] Filed: May 16, 1994

[51] Int. Cl.[6] ..... A63B 1/00

[52] U.S. Cl. ..... 482/43; 482/38; 482/41; 482/94; 482/123

[58] Field of Search ..... 482/23–29, 33, 482/35–39, 41, 43, 69, 94, 123, 133, 138, 904; D21/240, 243, 245, 246; 602/34, 36; 606/241; 472/15, 20, 32, 49, 118, 125, 135

[56] References Cited

U.S. PATENT DOCUMENTS

| | | | |
|---|---|---|---|
| 3,006,645 | 5/1959 | Frazier . | |
| 3,201,198 | 8/1965 | Fenner et al. | 482/38 |
| 3,339,925 | 9/1967 | Nissen | 482/29 |
| 3,606,315 | 9/1971 | Green | 482/37 |
| 3,674,262 | 7/1972 | Tomalinas, Jr. | 472/118 |
| 4,114,873 | 9/1978 | Jones | 482/51 |
| 4,296,924 | 10/1981 | Anzaldua et al. | 482/94 |
| 4,410,175 | 10/1983 | Shamp . | |
| 4,577,859 | 3/1986 | Gossett | 482/8 |
| 4,620,701 | 11/1986 | Mojden | 482/41 |
| 5,221,241 | 6/1993 | Bare, II . | |

FOREIGN PATENT DOCUMENTS

| | | | |
|---|---|---|---|
| 0455279 | 7/1913 | France | 482/94 |
| 1105204 | 7/1984 | U.S.S.R. | 482/38 |
| 1416140 | 8/1988 | U.S.S.R. . | |
| 1556691 | 4/1990 | U.S.S.R. . | |

*Primary Examiner*—Stephen R. Crow
*Assistant Examiner*—Jeanne M. Clark
*Attorney, Agent, or Firm*—Zarley, McKee, Thomte, Voorhees, & Sease

[57] ABSTRACT

A frame for hanging exercise equipment includes a base having front and rear sides and opposite ends for resting on a floor. The base is further equipable with inclineable end extensions. Crossing first and second overhead supports have generally horizontal bars connecting vertical legs which are attached to the base sides in the case of the first support and the ends in the case of the second support. Fixed and slideable types of anchors are disposed on the supports for pivotally hanging exercise equipment. Horizontal guide bars are demountably attached between a pair of cross members which are height adjustably mounted on the legs of the first overhead support. The distance from the legs of the first overhead support to each horizontal guide bar is also adjustable. The guide bar ends are mounted to a tubular slide which slides over the end of the cross member. The slide can be selectively secured by a removable pin to any one of a plurality of spaced apart mounting holes in the cross member. Using both types of anchors, the frame can be configured with resilient cord assemblies attached to a Pond belt or conventional exercise equipment, such as rings, to achieve adjustable resistance for exercise. Furthermore, when pulleys are attached to the anchors, a cable and hoist system is utilized with the resilient cords to unweight the exerciser for an added dimension of readily adjustable resistance during exercise.

8 Claims, 6 Drawing Sheets

FRAME FOR A VARIABLE IMPACT THERAPY SYSTEM

BACKGROUND OF THE INVENTION

This invention relates to the field of therapeutic devices for improving the mobility and strength of patients. In particular, this invention relates to a variable impact therapy system in which various exercises involving virtually the entire body can be performed.

Among the shortcomings of existing exercise systems is the inability of these systems to easily accommodate persons of different weight. In addition, they either cannot be adjusted to prevent substantial impact of the exerciser on the floor or can be adjusted only with considerable difficulty.

In U.S. Pat. No. 5,221,241, this inventor disclosed a gymnastic training device having adjustably resilient assemblies for supporting a gymnast in a Pond training belt. The shock absorber elements of that device are adjustable so that the athlete experiences no more than 15 to 20 pounds of impact on the supporting surface. However, this concept of variable impact or adjustable unweighting has not heretofore been effectively adapted to a system for therapeutic exercise.

During exercise, especially for rehabilitation from an injury or illness, it is important that the resistance encountered be adjustable, for the comfort and safety of the patient, as well as the progression of therapy. Existing rehabilitative devices typically do not provide easily adjustable resistance during exercise. Furthermore, many of the existing devices act only on certain muscle groups or limbs of the patient. Many existing rehabilitative exercise systems require that the patient be closely monitored by a care provider or medical personnel during exercise because the system offers little protection against the patient falling and/or injuring themselves. Patients with neuromuscular conditions can be seriously injured if they collapse while using existing exercise devices. Sometimes the patients who need rehabilitative exercise the most are those in wheelchairs. Existing exercise systems do not easily accommodate wheelchairs or similar devices.

It is therefore a principal object of this invention to provide an exercise system which can be easily adapted to persons of different weight, strength, and mobility.

A further object of this invention is to provide an exercise device which uses resilient supporting means for the exercises which can be easily adjusted to accommodate the specific weight of the exerciser and to regulate the degree of impact that the exerciser has with a supporting surface.

A still further object of this invention is to provide a exercise device which can be adjusted to prevent the user from engaging the floor while in a substantial horizontal position.

Another object of this invention to provide an adjustable resistance therapy system for rehabilitation, training, and exercise.

Another object of this invention is to provide a therapy system which is readily adaptable for use by people with disabilities, limited mobility, or a wheelchair.

A further object of this invention is to provide a therapy system which can be safely used by the patient with minimal supervision from the care provider or medical personnel.

A further object of this invention is to provide a variable resistance therapy system wherein the resistance applied is easily set and measured.

A still further object of this invention is to provide an exercise device having adjustably inclineable extensions at the ends of its base whereon a mat is laid to form a padded inclined exercise surface.

A further object of this invention is to provide an exercise device with one or more vertically adjustable horizontal guide bars for use during exercise.

A further object of this invention is to provide a flexible exercise device which uses both fixed and slidably adjustable eyelets to suspend a plurality of different pieces of exercise equipment, including but not limited to static rings, a trapeze bar, handles and the like.

A further object of this invention is to provide a device for adjustable resistance therapy which is durable in manufacture and easy to assemble.

A still further object of this invention is to provide a exercise device which can be utilized in either a self-standing format, or adapted to the ceiling structure of a building.

A further object of the present invention is to provide a therapy system which suspends the patient at adjustable heights from the floor within the device.

A further object of the present invention is to provide a therapy system which is flexible and can be used for entertainment or exercise purposes.

These and other objects will be apparent to those skilled in the art.

SUMMARY OF THE INVENTION

The variable impact therapy system of this invention is centered about a self-standing frame for hanging exercise equipment. The basic frame has a base with front and rear sides and opposite ends for resting on a floor. Inclineable extensions can also be provided on the ends. Crossing first and second overhead supports have generally horizontal bars connecting a pair of vertical legs which are attached to the base sides in the case of the first support and the base ends in the case of the second support.

One or more horizontal guide bars demountably attach to the frame between cross members which are height adjustably mounted on the legs of the first overhead support. Therefore, each guide bar extends between the sides of the frame and can be adjusted to a variety of vertical positions within the frame. The distance of each guide bar from the first overhead support is also adjustable. Each guide bar is attached to a tubular slide which slides over an end of the cross member and can be selectively secured by a removable pin to any one of a plurality of horizontally spaced apart mounting holes in the cross member. The exerciser may perform exercises on or against the guide bar(s). The guide bar is helpful as a means for steadying the exerciser.

Fixed and slidably adjustable types of anchors are disposed along the supports for pivotally hanging exercise equipment on the frame. Various conventional exercise equipment, including but not limited to a Pond belt, rings, handles, and trapeze bars can thereby be anchored or hung on the frame. Adjustable resilience can be provided by using shock absorber elements which include resilient cord assemblies. The density of stretch for these assemblies is known to be adjustable by adding or removing bungy cords. By using adjustable anchors to mount the resilient cord assemblies to the frame, the length of stretch of the assemblies is variable, as well. Thus, an extremely flexible exercise system is provided in the present invention.

Another dimension of adjustability is achieved when pulleys are attached to the anchors on the longitudinal overhead support. A cable runs through the pulleys and has its ends connected to the sides of a Pond belt via opposing resilient cord assemblies. A loop in the cable can be drawn downwardly by a hoist on the frame. This arrangement provides another opportunity to adjust the resistance encountered during exercise. The impact of the exerciser on the floor or a pad thereover can be varied. In other words, the exerciser can be effectively unweighted.

DETAILED DESCRIPTION OF THE PREFERRED EMBODIMENTS

The variable impact therapy system 10 of this invention is adapted for use by persons exercising for rehabilitational, training, or other purposes. It is adapted for therapeutic use by patients who are recovering from injuries including but not limited to those effecting the bones, muscles, nerves, or tendons.

Figure 1:
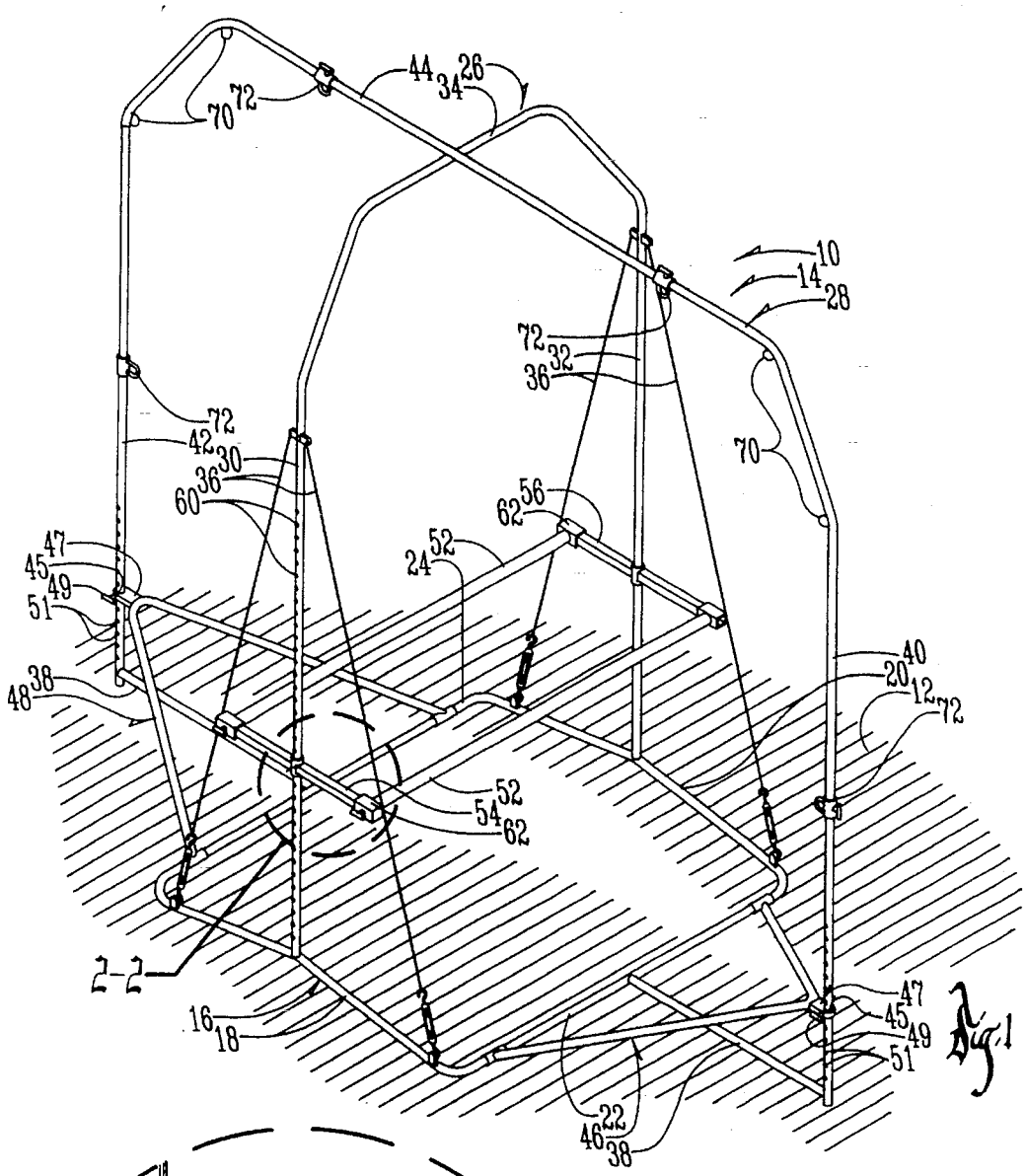
FIG. 1 is a perspective view of the self-standing frame of the present invention.

In FIG. 1, one of the preferred embodiments of this invention has a unique self-standing frame 14 which is adapted to rest on floor 12. Preferably, frame 14 has a generally rectangular-shaped base 16 formed of rigid tubular material. Base 16 includes front and rear sides 18, 20 and opposite ends 22 and 24 for resting on the floor. Front and rear sides 18, 20 have central portions which are raised off of floor 12 to provide clearance for reasons to be described later.

Frame 14 also includes first and second overhead support members 26 and 28. First overhead support 26 comprises vertical legs 30 and 32 which are attached to the front 18 and rear 20 sides of base 16 respectively. Vertical legs 30 and 32 are interconnected by a generally horizontally member 34. Furthermore, it is preferable that a pair of opposing conventional guide wires 36 adjustably connect the outer ends of front 18 and rear 20 with the upper portion of legs 30 and 32 to keep first overhead support 26 perpendicular to base 16.

Second overhead support 28 is secured to base 16 by arms 38 which are attached midway along ends 22 and 24. Second overhead support 28 has a pair of vertical legs 40 and 42 and a generally horizontal member 44 extending therebetween. Horizontal member 44 traverses member 34 of first overhead support member 26. It is contemplated that vertical legs 30 and 32 could be of a telescoping or end-fitting tubular construction to facilitate assembly, breakdown, and transport.

Figure 7:
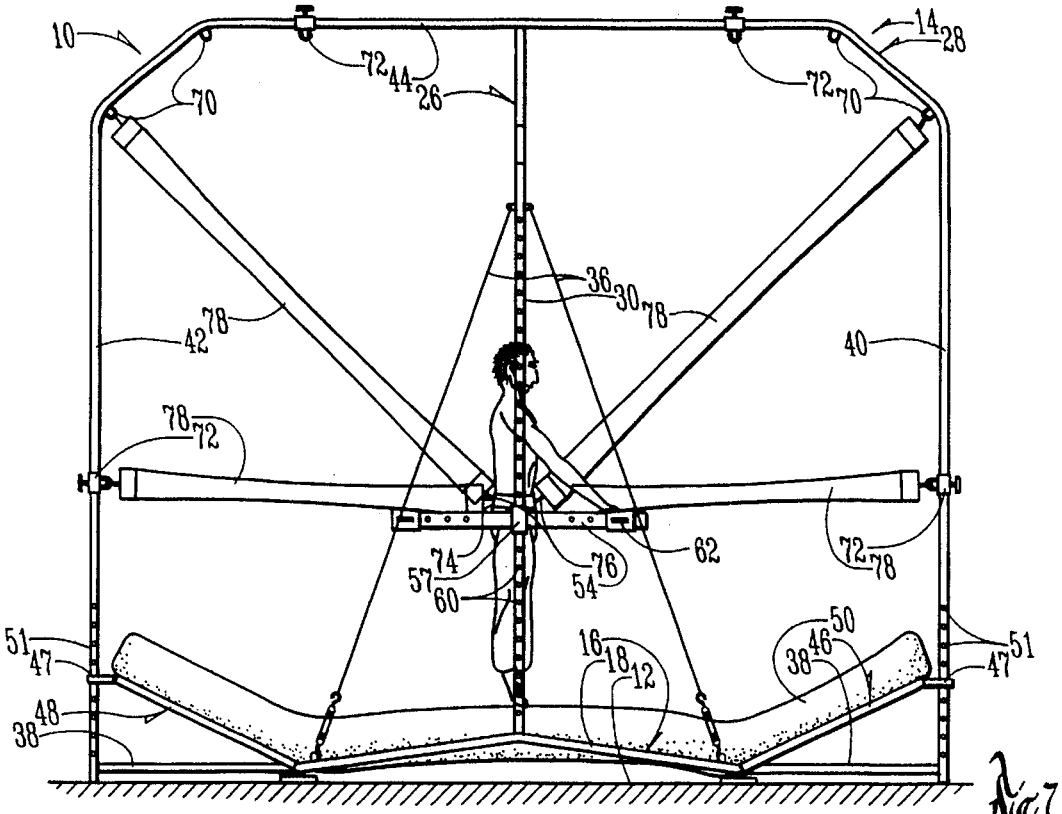
FIG. 7 is a front view of the therapy system of this invention showing four point suspension of the exerciser in the belt.

FIG. 1 also shows ends 22 and 24 of base 16 to have pivotally attached and adjustably inclineable extensions 46 and 48. The distal ends of extensions 46 and 48 are secured to vertical legs 40 and 42 by any conventional vertically adjustable means. For example, tongue 47 has a hole 45 adapted to slidably receive one of the vertical legs 40 or 42 and is attached to the remote end of the respective extension 46 or 48. A suitable stop means, such as a removable T-handle pin 49, is inserted into one of a plurality of vertically spaced apart holes 51 at the lower end of legs 40 or 42 to set the angle of inclination for extensions 46 and 48 respectively. As shown in FIG. 7, this feature is particularly useful when a padded mat 50 is placed over base 16 because the ends of mat 50 can thereby be raised to provide a soft inclined surface for exercise and protection.

Figure 2:
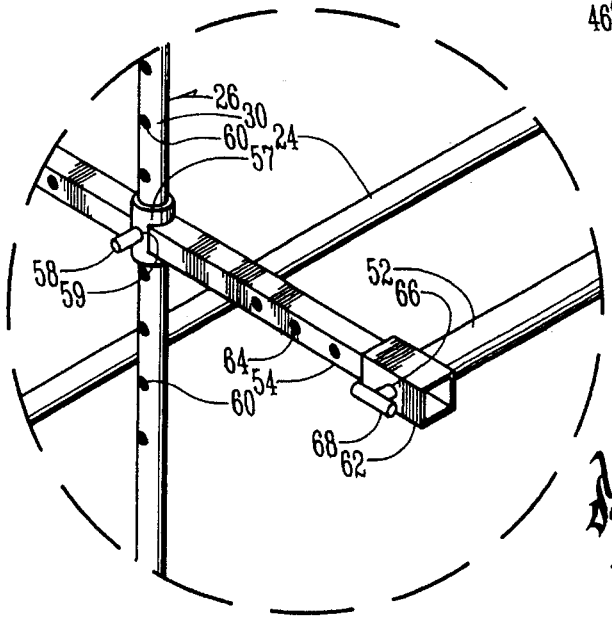
FIG. 2 is an enlarged view showing the horizontal guide bars adjustably and removably mounted to the frame.

Referring again to FIG. 1, a pair of generally parallel and horizontal guide bars 52 are preferably detachably mounted along the ends of cross members 54 and 56. It is also contemplated that a single guide bar 52 can be used alone at either end of the cross members. Cross members 54 and 56 each have a central tubular member 57 which is slidably mounted on the respective vertical legs 30 or 32, as best seen in FIG. 2. Tubular member 57 has a generally horizontal hole 59 extending into its interior. Guide bars(s) 52 can be raised or lowered and secured into position by inserting a pin 58 through hole 59 of member 57 and into one of a plurality of vertically spaced apart holes 60 in legs 30 and 32. Holes 60 span substantially the entire length of vertical legs 30 and 32. Therefore, cross members 54 and 56 can be used to adjust the guide bar(s) 52 attached thereto to a variety of heights from floor 12, as seen in FIG. 1.

The horizontal position of each guide bar 52 is similarly adjustable via a tubular slide 62 having a generally horizontal hole 66 thereinto, as best seen in FIG. 2. Slide 62 slips over either end of cross members 54 or 56. The outer portions of cross members 54 and 56 have a plurality of spaced apart holes 64 therein. Holes 66 and 64 are aligned and a T-handled pin 68 is inserted therethrough to removably secure and position guide bar 52.

Figure 3:
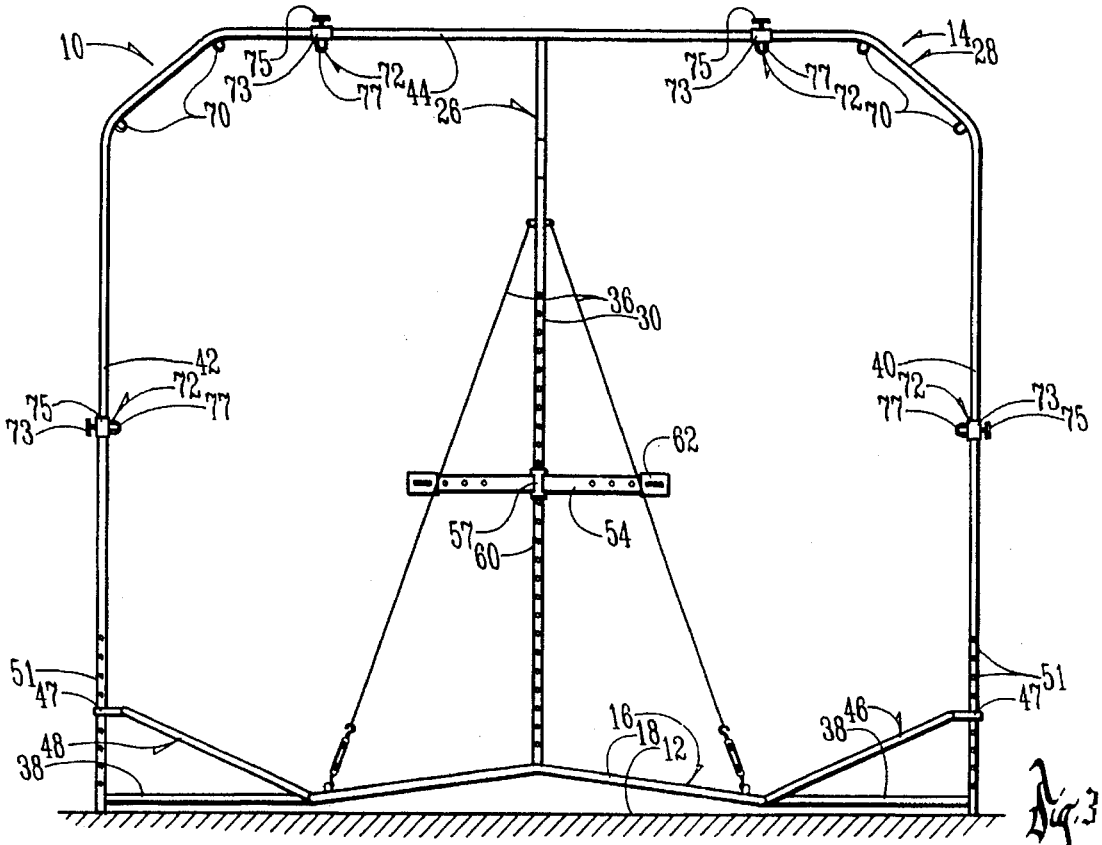
FIG. 3 is a front view of the self-standing frame of this invention.
Figure 4:
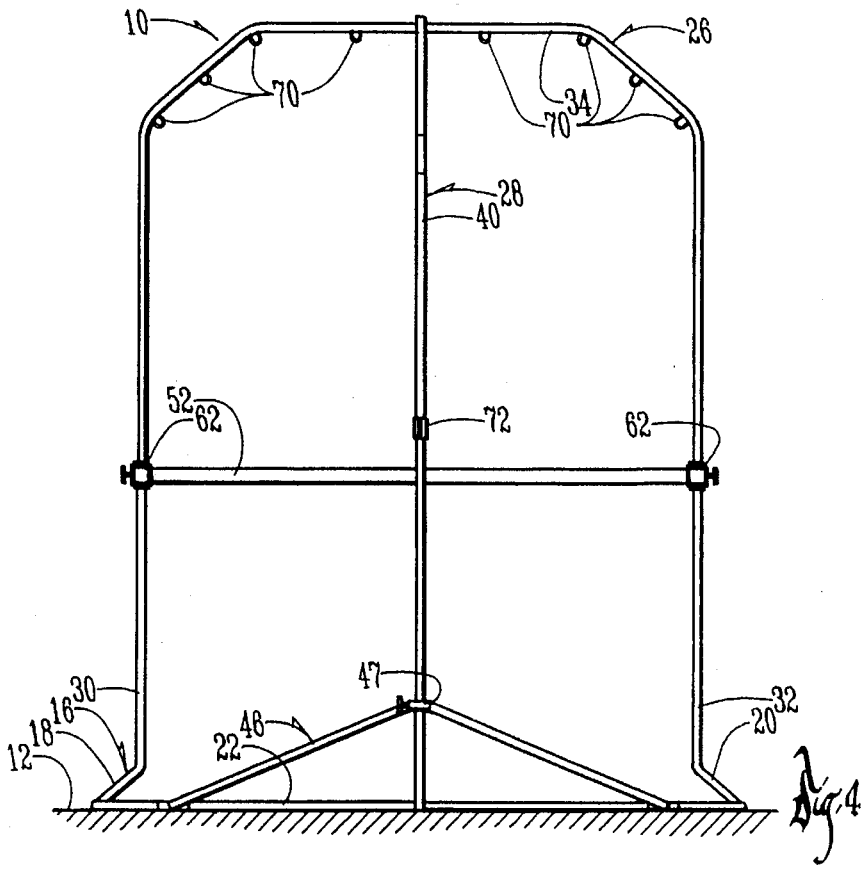
FIG. 4 is a side elevation view of the self-standing frame of this invention.

In FIGS. 3 and 4, frame 14 has various fixed eyelets 70 and slidably adjustable eyelets 72 disposed as anchoring means along overhead supports 26 and 28. As further described below, these eyelets are adapted to anchor various items, including but not limited to exercise equipment, pulleys, and cables.

As best seen in FIG. 3, adjustable eyelets 72 are slidably and rotatably adjustable. Eyelets 72 include a conventional tubular sleeve 73 having an inner diameter greater than the outer diameter of supports 26 and 28 so as to encircle the respective support. A T-handled clamp screw 75 is provided for securing sleeve 73 in position on support 26 or 28. An eye 77 is conventionally secured to sleeve 73 so that items may be anchored thereto. When tightened, screw 75 engages support 26 or 28 and prevents adjustable eyelet 72 from moving relative to the support.

Figure 5:
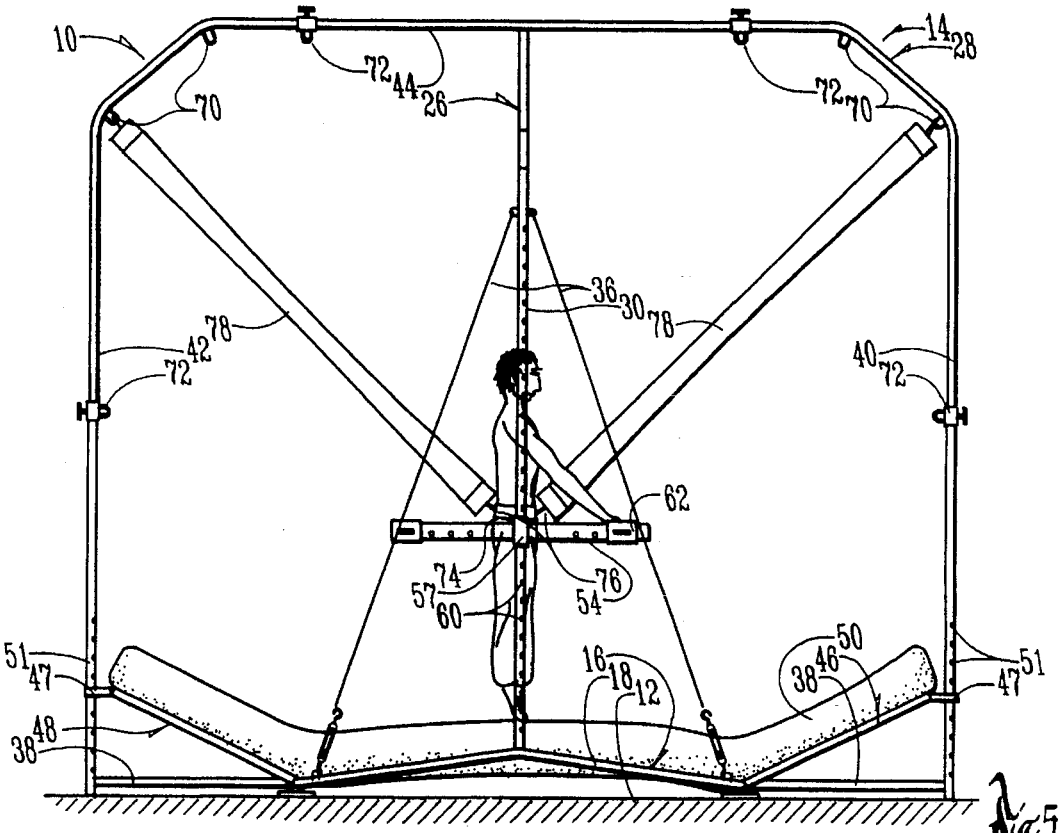
FIG. 5 is a front view of the frame of this invention showing the floor mat and Pond belt.

In FIG. 5, a conventional Pond belt 74 is secured to frame 14 by a pair of adjustably resilient means, such as shock absorber elements 78. Fixed eyelets 70 anchor one end of shock absorber elements 78 to frame 14 near the tops of vertical legs 40 and 42 of the laterally disposed second overhead support 28. Pond belt 74 is normally worn around the waist or torso of the exerciser. Swivels 76 are provided on opposite sides of Pond belt 74 and are adapted to rotate about a horizontal axis. The other end of each shock absorber element 78 is secured to the respective swivel 76 on Pond belt 74.

The shock absorber elements 78 themselves are conventional and are not per se the subject of this invention. However when used in the manner just described, shock absorber elements 78 provide an adjustably resilient means for suspending an exerciser and varying the exerciser's impact with an exercise surface.

Elements 78 are comprised of upper and lower discs which have a centrally protruding eyelet. Each disc has a plurality of radial slits which are adapted to receive compressively the end portions of hollow resilient cords, such as those manufactured under the trademark BUNGEE. The cords each have enlarged diameter upper and lower ends which are created by forcibly inserting short lengths of dowels into the end of the hollow cords. The enlarged diameter upper and lower ends of the cords are sufficiently great to prevent them from longitudinally slipping through the radial slits. A conventional band clamp encircles the perimeter of each of the discs and is tightened on the periphery thereof. The band clamps prevent the cords from moving laterally out of the radial slits.

The resiliency of shock absorber elements 78 can be selectively adjusted by removing the band clamps from the disc, and adding or removing cords as the situation may require. If the exerciser is a heavy adult, all the cords may be used. If the exerciser is a lighter weight child, for example, some of the cords can be removed.

A padded floor mat 50, preferably removable, covers base 16 of frame 14 in FIG. 5. Extensions 46 and 48 are tilted upwardly from base 16 as to provide a padded inclined surface at either end. Shock absorber elements 78 effectively unweight the exerciser so that they may traverse the frame and/or the mat to accomplish various exercises. The impact of the exerciser on mat 50 can be varied to match the needs and capabilities of the individual exerciser. Guide bars 52 can be utilized by the exerciser for additional support or to perform exercises thereon. The height of guide bars 52 can be adjusted to fit the needs of the particular patient and the therapeutic goals.

Another configuration for exercise utilizing this invention is shown in FIG. 7. Four shock absorber elements 78 are arranged into opposing upper and lower pairs. Each shock absorber element 78 has one end attached to a swivel 76 disposed on either side of the Pond belt 74. The other end of each upper shock absorber element 78 is anchored to a fixed eyelet 70 that is disposed near the top of vertical legs 40 and 42 respectively. The other end of each lower shock absorber element 78 is secured by a slidably adjustable eyelet 72 to the lower portion of respective legs 40 and 42. Thus, the exerciser is suspended from the four corners of second overhead support 28.

It should be apparent that one can adjust the effective weight of the exerciser and the resistance encountered during exercise by changing the number of resilient cords utilized in the shock absorber elements 78. However, further adjustability is achieved by changing the positions of the distal ends of the lower shock absorber elements 78. Changing the anchored position effectively changes the length of the shock absorber element and thereby the forces on the exerciser. Slidably adjustable eyelets 72 allow the lower shock absorber elements 78 to be positioned anywhere along vertical legs 40 and 42, so long as they do not interfere with the adjustment of base extensions 46 and 48. Therefore, the exerciser can be very accurately positioned within frame 14 and unweighted as desired. Any number of conventional exercises may be performed in this position. If desired, the guide bars 52 may be removed or they may be left in place as shown in FIG. 7. Preferably, a padded mat 50 is also provided under the exerciser.

Figure 8:
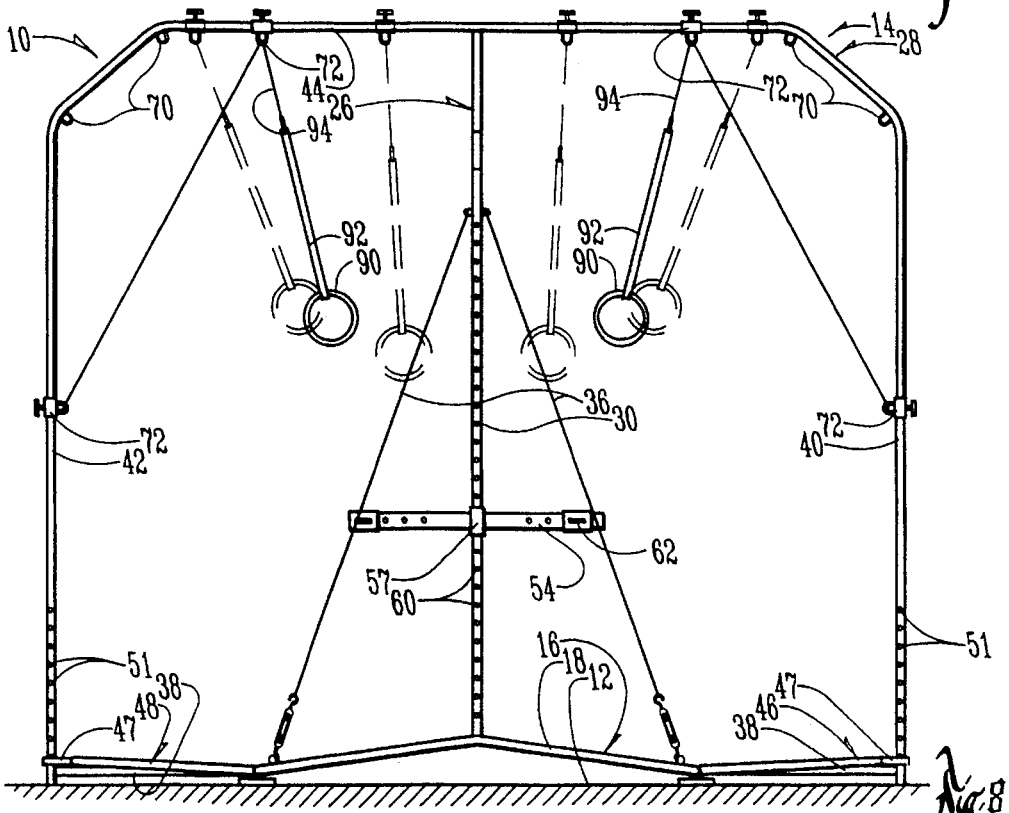
FIG. 8 is a front view of the therapy system of this invention showing rings adjustably attached to the frame.

A configuration for exercising with static rings can also be provided with this invention, as seen in FIG. 8. Preferably, two rings 90 each having a web strap 92 attached thereto are adjustably hung from support 28 by respective cables 94. One end of cable 94 is attached to a slidably adjustable eyelet 72 mounted on vertical leg 40 or 42. Eyelet 72 is positionable anywhere along vertical leg, so long as it does not interfere with the inclineable extensions 46 and 48. Furthermore, cable 94 passes through a second slidably adjustable eyelet 72 mounted overhead on horizontal member 44. With the slidably adjustable eyelets shown, the vertical and horizontal position of ring 90 can be easily adjusted. The effective angle of pull on the ring is also affected.

FIG. 8 further illustrates a configuration in which mat 50 has been removed and base extensions 46 and 48 have been lowered to be roughly level with the floor 12. Therefore, a wheelchair patient can wheel themselves into frame 14 to use hanging exercise equipment such as rings 90, a trapeze bar, or handles to improve their upper body strength. In this situation, Pond belt 74 is not required because the adjustability of the hanging exercise equipment allows the patient to remain seated in their wheelchair.

Figure 9:
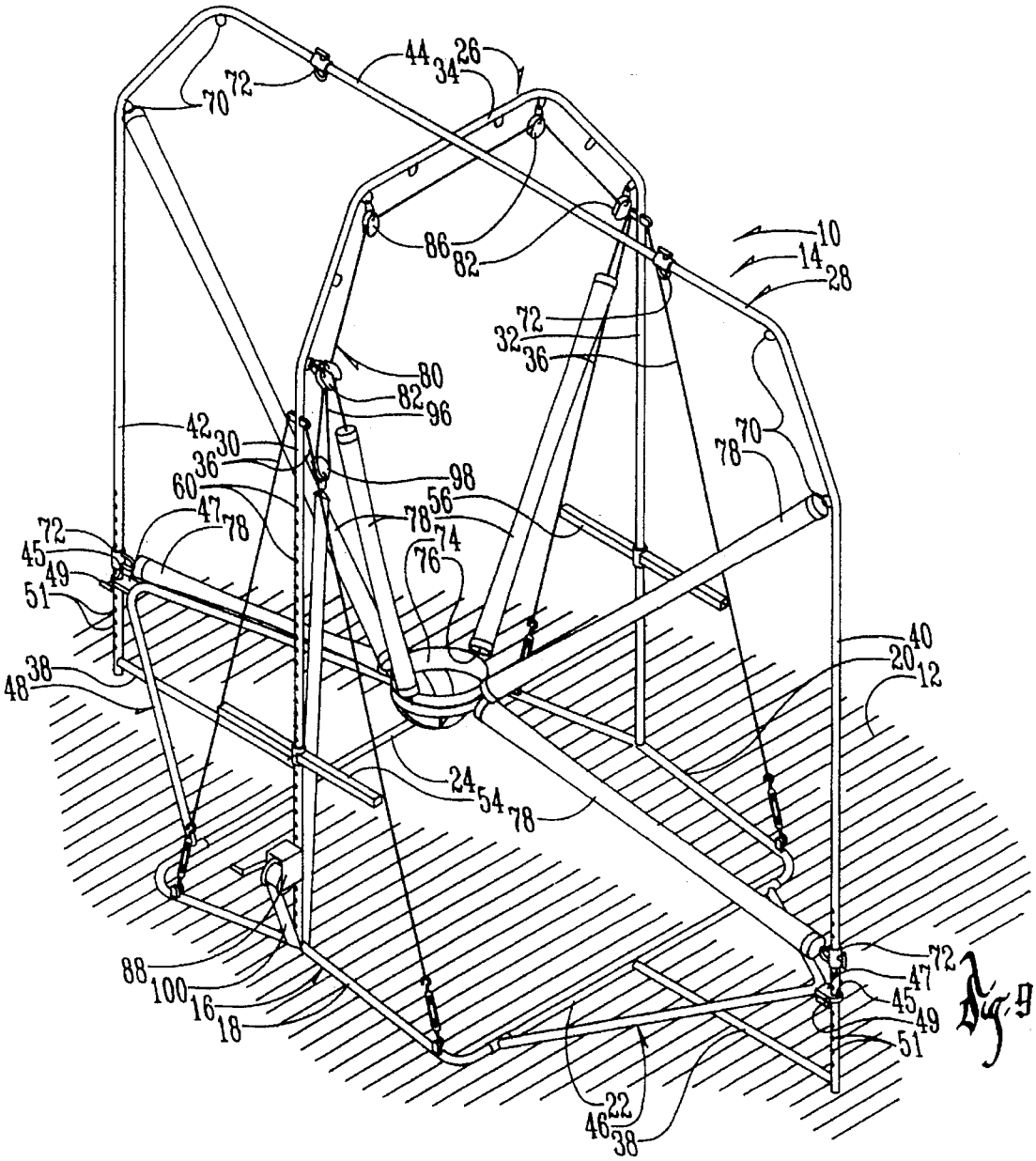
FIG. 9 is a perspective view showing six point suspension of the exerciser in the belt.

Another configuration for exercise equipment according to this invention is shown in FIG. 9. This configuration is similar to that shown in FIG. 7 except that a pair of shock absorber elements 78 are also anchored to first overhead support 26 and attached to swivels 76 at the front and rear of Pond belt 74. Six-way control of movement of the exerciser in belt 74 is thereby obtained.

Figure 6:
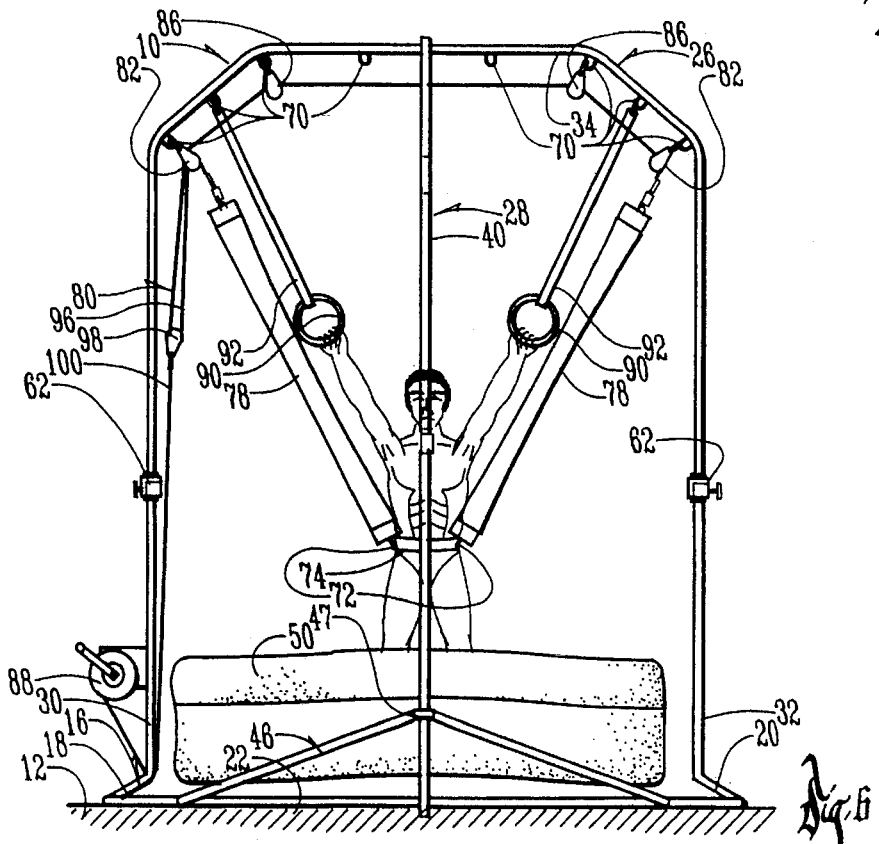
FIG. 6 is a side elevation view of the therapy system of this invention showing the Pond belt suspended by a hoist and cables extending through four pulleys and including overhead rings fixed on the frame.

In FIG. 6, an embodiment of this invention which results in even greater adjustability in exercise resistance is shown. Above a padded mat 50, a pair of lower pulleys 82 are disposed on first overhead support 26 near the tops of vertical legs 30 and 32, and are preferably anchored thereto by fixed eyelet 70. At least one elevated pulley 86 is similarly secured by fixed eyelet 70 to horizontal member 34 of support 26. A first cable 80 having two ends has one end attached to the upper end of the shock absorber element 78 located on the right and another end attached to the upper end of the shock absorber element 78 located on the left. First cable 80 extends from the right shock absorber element 78 through pulleys 82 and 86 on the right, then through pulleys 86 and 82 on the left. A loop 96 of first cable 80 hangs downwardly from pulley 82 on the left to engage pulley 98. Finally, the first cable 80 returns upwardly through pulley 82 and is attached to the left shock absorber element 78. The lower end of pulley 98 is conventional secured to a webbed band 100 which extends under the raised central portion of base 16. The free end of webbed band with respect to the pulley 98 is connected to a conventional ratchet crank hoist 88. Hoist 88 is mounted on the outside of support 26 to avoid interfering with slidably adjustable eyelets 72 or the exercise taking place within frame 14. Conventional hoist 88 may be operated by hand or with a motorized wrench or other suitable means. With the above-described structure, another means of adjustably unweighting the exerciser is provided to augment the adjustability of shock absorber elements 78. The position of the exerciser and thereby their impact on the mat 50 can be adjusted. Adjustable resistance can also be applied to further the therapeutic value of staticly hung conventional exercise equipment, such as the rings shown.

Figure 10:
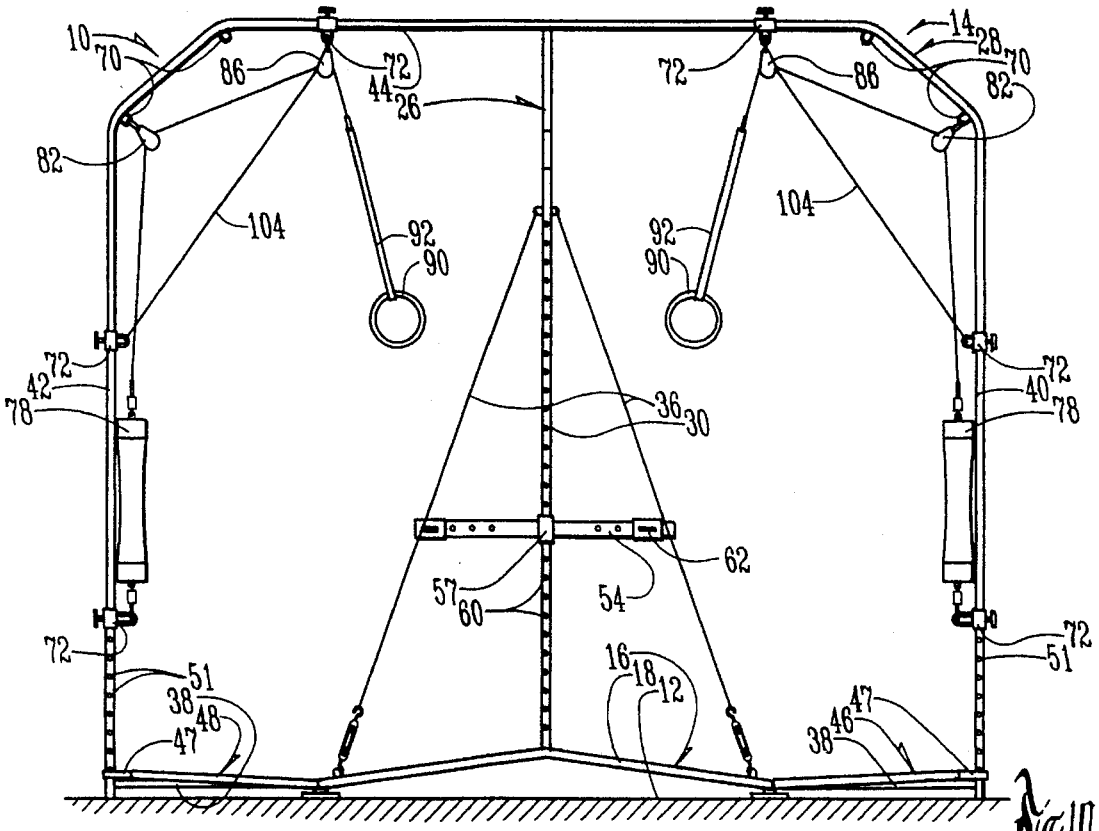
FIG. 10 is a front view of the system of this invention showing rings adjustably and resiliently attached to the frame.

In FIG. 10, an adjustably resilient set of dynamic rings 90 are provided. The resilience is provided by a pair of shock absorber elements 78 which are secured just above inclineable extensions 46 and 48 by a adjustable eyelet 72. One end of a cable 104 is attached to the upper end of shock absorber element 78. The other end of cable 104 is attached to adjustable eyelet 72 on leg 40 or 42 above the shock absorber element 78. Cable 104 passes from shock absorber element 78 through a laterally disposed pulley 82 fixed by eyelet 70 on leg 40 or 42, then through an elevated pulley 86. Elevated pulley 86 is attached to horizontal member 44 of second overhead support 28, by adjustable eyelet 72. Finally, cable 104 loops through web strap 92 from which a ring 90 is suspended. Cable 104 returns upwardly back through pulley 86 and then extends downwardly to its connection with adjustable eyelet 72 mounted on vertical leg 40 or 42 of second overhead support 28 above the shock absorber element 78. Thus, the extent to which the rings hang down and the effective angle of pull for the exerciser adjusted by the adjustable eyelets located laterally and overhead. It is contemplated that other forms of exercise equipment could be similarly attached to the system. For example a trapeze bar or handles might be suspended in this manner.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A frame for hanging exercise equipment, comprising:

a base having a front side and a rear side and opposite ends for resting on a floor;

a first overhead support connecting said sides of said base and having a pair or generally vertical legs attached to and extending upward respectively from said base sides and generally horizontal bar connecting said legs;

a second overhead support connecting said ends of said base and having a pair of spaced apart generally vertical legs operatively attached to and extending upward respectively from said opposite ends and a generally horizontal bar connecting said legs of said second overhead support and crossing said horizontal bar of said first support;

anchor means disposed on said supports for pivotally hanging exercise equipment therefrom; and at least one end extension having a lower end pivotally mounted to one of said ends of said base and an upper end secured by height adjustable means to said second overhead support leg adjacent said end of said base so as to make said end extension inclineable with respect to said base.

2. The frame of claim 1 wherein said height adjustable means comprises a tongue member rigidly attached to said upper end of said extension, said tongue member having a hole therein for slidably engaging said leg, and stop means mounted and vertically positionable along said leg for engaging said tongue and preventing downward movement thereof.

3. The frame of claim 2 wherein said leg has a series of vertically spaced apart holes therein and said stop means comprises a pin removably insertable into any one of said vertically spaced holes.

4. The frame of claim 1 wherein at least one of said anchor means is position adjustable along the supports.

5. The frame of claim 1 wherein said front and rear sides of the base have a central portion which is elevated off the floor and said first overhead support legs extend from said central portion.

6. The frame of claim 1 further comprising at least one generally horizontal guide bar demountably attached between a pair of cross members, one of said cross members being mounted on each of the first overhead support legs.

7. The frame of claim 6 further comprising means for vertical adjustment of said guide bar wherein said legs have a series of vertically spaced apart holes therein and said cross member has a mounting hole therein and a removable pin is provided for fastening the cross member to the respective leg when said mounting hole and vertically spaced apart hole are aligned.

8. The frame of claim 7 wherein said vertically spaced apart holes span substantially the entire length of the legs.

* * * * *